United States Patent [19]

Finnegan

[11] Patent Number: 4,572,409

[45] Date of Patent: Feb. 25, 1986

[54] DRIP FREE CAULKING GUN

[76] Inventor: Gary Finnegan, 351 10th St., #1, Santa Rosa, Calif. 95401

[21] Appl. No.: 490,886

[22] Filed: May 2, 1983

[51] Int. Cl.[4] ..... B67D 5/42

[52] U.S. Cl. ..... 222/391; 188/67; 403/104; 403/329; 222/327

[58] Field of Search ..... 74/531; 188/67, 82.7; 403/104, 109, 329; 222/327, 391

[56] References Cited

U.S. PATENT DOCUMENTS

| | | | |
|---|---|---|---|
| 1,194,991 | 8/1916 | Gervais | 188/67 X |
| 1,758,129 | 5/1930 | Shapiro | 403/104 X |
| 4,009,804 | 3/1977 | Costa et al. | 222/391 |
| 4,356,938 | 11/1982 | Kayser | 222/327 |

*Primary Examiner*—Joseph J. Rolla
*Assistant Examiner*—Michael S. Huppert
*Attorney, Agent, or Firm*—Andrew A. Steiner; David C. Ripma

[57] ABSTRACT

A no drip caulking gun which includes a rigid open barrel. The caulking cartridge is inserted in the barrel. A rod is coaxially movable with the barrel. At the end of the rod a plunger is mounted. The forward motion of the plunger against the cartridge forces the caulking compound out of the cartridge, when the forward motion is stopped the built up pressure in the cartridge kicks the rod backwardly.

4 Claims, 3 Drawing Figures

DRIP FREE CAULKING GUN

BACKGROUND OF THE INVENTION

There are numerous Caulking Guns disclosed in the prior art.

U.S. Pat. No. 2,102,939 Bishop
U.S. Pat. No. 2,367,347 Good
U.S. Pat. No. 2,732,102 Ekins
U.S. Pat. No. 4,126,251 Subwick
U.S. Pat. No. 4,009,804 Costa The after drip of the caulking compound in at least one of the patents mentioned is reduced, but because of the impeded rearward motions of the plunger, the after drip is not completely stopped.

SUMMARY OF THE INVENTION

The purpose of the present invention is to produce a caulking gun which after the extrusion of the desired quantity of caulking compound, instantenously stops after flow.

The caulking gun comprises a standard barrel, one end of the barrel is constructed for holding the cartridge and allowing the protrusion of its nozzle, the other end of the barrel is closed by a plate having a hole, the said barrel terminates in a handle. A trigger is pivotally mounted on the handle. A rod terminating in a plunger is inserted through a hole in the handle, means are provided to move the rod coaxially with the barrel by pressing down on the trigger. As will be seen in the detailed description, when the trigger is released, the rod instantaneously will be kicked backwardly.

DETAILED DESCRIPTION

Figure 3:
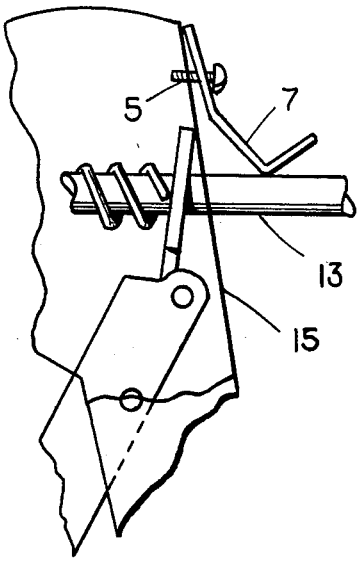
FIG. 3 is a detailed view of the spring steel on the handle and its relation to the rod.
Figure 1:
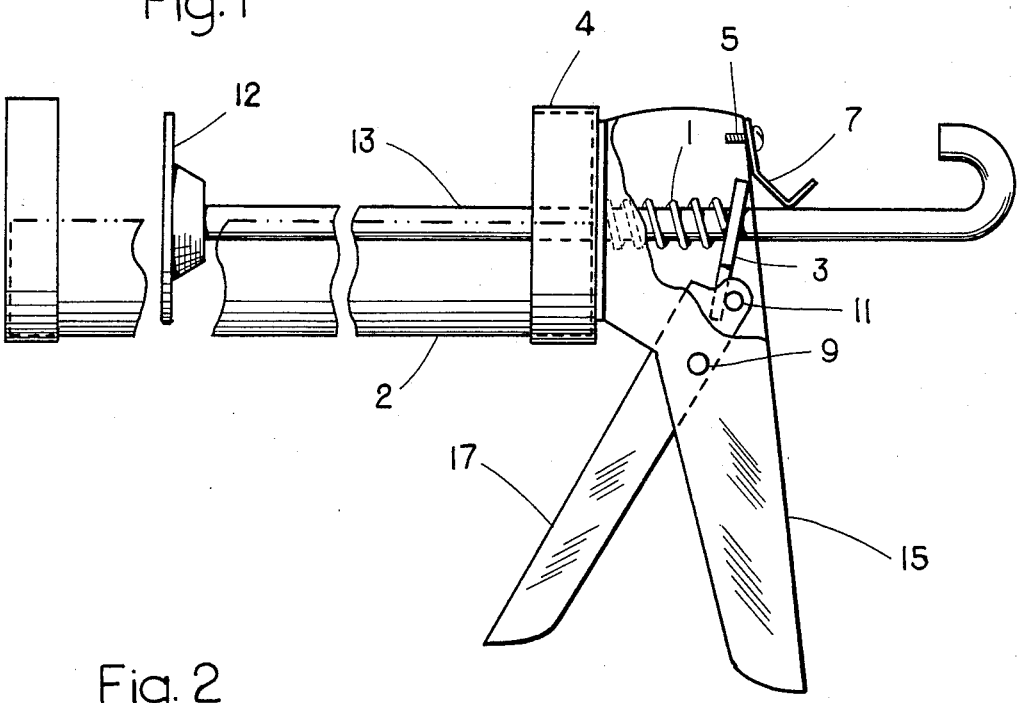
FIG. 1 is a cut-away view of the gun.
Figure 2:
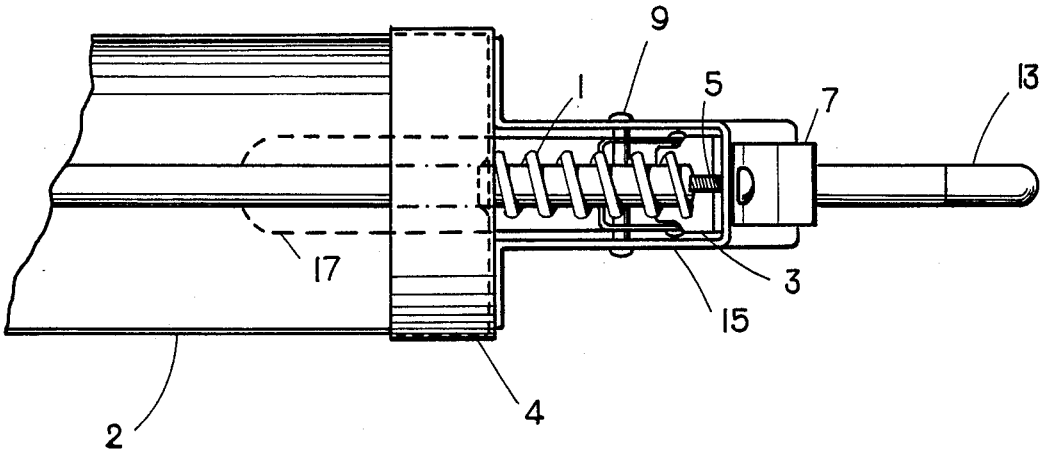
FIG. 2 is a detailed view of the end portion of the gun opposite to the plunger.

Referring now to the drawings, the gun comprises a standard barrel 2, having at one end a handle 15, a trigger 17 is pivotally mounted on the handle 15, a rod 13 is inserted through a hole in the handle 15 along the barrel 2. The rod terminates in a plunger 12, a driving dog 3, on the rod is tilted and moved forwardly by the trigger. The said dog forces the rod coaxially to the barrel forward, the plunger exerts pressure on the caulking compound containing cartridge, not shown.

A compression spring 1 placed on the rod between the dog 3 and cylinder 4 at the end of the barrel, upon release of the trigger, the spring kicks back the plate and the rod 13 is forced rearwardly through the pressure exerted by the cartridge. A U shaped spring formed of steel 7 is attached to the handle by a screw 5, the bottom of the spring 7 rests on the rod 13 and exerts pressure thereon, the pressure can be regulated by the screw 5. The pressure exerted by the spring 7 on the rod regulates the rearward motion of the rod.

I claim:

1. A drip free caulking gun having a barrel for receiving a caulking cartridge, said gun consisting of: a handle mounted on the barrel, a rod extending along the barrel and movable coaxially with the barrel, a trigger mounted on said handle, a single dog on the rod, said dog being activated by said trigger for moving said rod forwardly to exert pressure against a caulking cartridge in the barrel, said dog and rod being movable rearwardly upon release of said trigger through built up pressure in a caulking cartridge in the barrel, and a spring having one end attached to the handle and an opposite end of said spring directly contacting and exerting pressure on said rod to regulate the rearward motion of said rod, such that when the trigger is released said dog and rod are movable rearwardly and the flow of caulking compound is stopped.

2. A drip free caulking gun as in claim 1, including a screw for attaching said spring to the handle for adjusting the pressure exerted in said rod by said spring.

3. A drip free caulking gun as in claim 2, in which said spring is U shaped, the bottom of which rests on said rod.

4. A drip free caulking gun as in claim 1, including a compression spring for exerting pressure between the barrel and said dog.

* * * * *